US006284067B1

(12) United States Patent
Schwartz et al.

(10) Patent No.: US 6,284,067 B1
(45) Date of Patent: Sep. 4, 2001

(54) METHOD FOR PRODUCING ALLOYED BANDS OR STRIPS ON PISTONS FOR INTERNAL COMBUSTION ENGINES

(75) Inventors: Frederick A. Schwartz, Woodbury; Mary Helen McCay; T. Dwayne McCay, both of Monteagle; Narendra B. Dahotre, Tullahoma; John Brice Bible, South Pittsburg; John A. Hopkins, Tullahoma, all of TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/346,289

(22) Filed: Jul. 2, 1999

(51) Int. Cl.[7] ..... C23C 4/06

(52) U.S. Cl. ..... 148/525; 148/565; 219/121.82; 219/121.85; 427/556; 427/597

(58) Field of Search ..... 148/512, 525, 148/565; 427/556, 597; 219/121.82, 121.85

(56) References Cited

U.S. PATENT DOCUMENTS

| | | |
|---|---|---|
| 3,705,758 | 12/1972 | Haskal . |
| 3,848,104 | 11/1974 | Locke . |
| 3,986,767 | 10/1976 | Rexer et al. . |

(List continued on next page.)

FOREIGN PATENT DOCUMENTS

| | | |
|---|---|---|
| 4126351 | 2/1993 | (DE) . |
| 876870A1 | 4/1998 | (EP) . |
| 279692 | 11/1988 | (JP) . |
| 401083676A | 3/1989 | (JP) . |
| 381082 | 4/1991 | (JP) . |
| 3115587A | 5/1991 | (JP) . |
| 403115531A | 5/1991 | (JP) . |
| 5285686 | 11/1993 | (JP) . |
| 1557193 | 4/1990 | (SU) . |
| 1743770 | 6/1992 | (SU) . |
| WO 95/21720 | 8/1995 | (WO) . |
| WO 97/47397 | 12/1997 | (WO) . |

OTHER PUBLICATIONS

ASM Handbook, vol. 6, Welding, Brazing, and Soldering, 1993.

Ayers, et al.; "A Laser Processing Technique for Improving the Wear Resistance of Metals," *Journal of Metals*, Aug. 1981, 19–23.

Belvaux, et al.; "A Method for Obtaining a Uniform Non–Gaussian Laser Illumination," *Optics Communications*, vol. 15, No. 2, Oct. 1975, 193–195.

Bett, et al.; "Binary phase zone–plate arrays for laser–beam spatial–intensity distribution conversion," *Applied Optics*, vol. 34, No. 20, Jul. 10, 1995, 4025–4036.

Bewsher, et al.; "Design of single–element laser–beam shape projectors," Applied Optics, vol. 35, No. 10, Apr. 1, 1996, 1654–1658.

Breinan, et al.; "Processing material with lasers," *Physics Today*, Nov. 1976, 44–50.

Bruno, et al.; "Laserbeam Shaping for Maximum Uniformity and Maximum Loss, A Novel Mirror Arrangement Folds the Lobes of a Multimode Laserbeam Back onto its Center," *Lasers & Applications*, Apr. 1987, 91–94.

Chen, et al.; "The Use of a Kaleidoscope to Obtain Uniform Flux Over a Large Area in a Solar or Arc Imaging Furnace," *Applied Optics*, vol. 2, No. 3, Mar. 1963, 265–571.

(List continued on next page.)

*Primary Examiner*—George Wyszomierski
(74) *Attorney, Agent, or Firm*—Duane, Morris & Heckscher LLP

(57) ABSTRACT

This invention relates to a method of using a laser to produce alloyed bands or strips on the surface of a piston for an internal combustion engine. More specifically, the present invention relates to a laser alloying method to produce superior wear resistant properties for an aluminum internal combustion engine piston.

15 Claims, 2 Drawing Sheets

U.S. PATENT DOCUMENTS

| | | | | |
|---|---|---|---|---|
| 4,015,100 | | 3/1977 | Gnanamuthu et al. . | |
| 4,017,708 | | 4/1977 | Engel et al. . | |
| 4,157,923 | | 6/1979 | Yen et al. . | |
| 4,212,900 | | 7/1980 | Serlin . | |
| 4,322,601 | | 3/1982 | Serlin . | |
| 4,434,189 | | 2/1984 | Zaplatynsky . | |
| 4,475,027 | | 10/1984 | Pressley . | |
| 4,480,169 | | 10/1984 | Macken . | |
| 4,495,255 | | 1/1985 | Draper et al. . | |
| 4,535,218 | | 8/1985 | Krause et al. . | |
| 4,617,070 | | 10/1986 | Amende et al. . | |
| 4,638,163 | | 1/1987 | Braunlich et al. . | |
| 4,644,127 | | 2/1987 | La Rocca . | |
| 4,720,312 | | 1/1988 | Fukuizumi et al. . | |
| 4,724,299 | | 2/1988 | Hammeke . | |
| 4,746,540 | | 5/1988 | Kawasaki et al. . | |
| 4,750,947 | | 6/1988 | Yoshiwara et al. . | |
| 4,801,352 | | 1/1989 | Piwczyk . | |
| 4,839,518 | | 6/1989 | Braunlich et al. . | |
| 4,847,112 | | 7/1989 | Halleux . | |
| 4,898,650 | | 2/1990 | Wu et al. . | |
| 4,904,498 | | 2/1990 | Wu . | |
| 4,964,967 | | 10/1990 | Hashimoto et al. . | |
| 4,981,716 | | 1/1991 | Sundstrom . | |
| 4,998,005 | | 3/1991 | Rathi et al. . | |
| 5,059,013 | | 10/1991 | Jain . | |
| 5,095,386 | | 3/1992 | Scheibengraber . | |
| 5,124,993 | | 6/1992 | Braunlich et al. . | |
| 5,130,172 | | 7/1992 | Hicks et al. . | |
| 5,147,999 | | 9/1992 | Dekumbis et al. . | |
| 5,196,672 | | 3/1993 | Matsuyama et al. . | |
| 5,208,431 | | 5/1993 | Uchiyama et al. . | |
| 5,230,755 | | 7/1993 | Pierantoni et al. . | |
| 5,247,155 | | 9/1993 | Steen et al. . | |
| 5,257,274 | | 10/1993 | Barrett et al. . | |
| 5,265,114 | | 11/1993 | Sun et al. . | |
| 5,267,013 | | 11/1993 | Spence . | |
| 5,290,368 | | 3/1994 | Gavigan et al. . | |
| 5,308,409 | * | 5/1994 | Kamimura et al. | 148/525 |
| 5,308,431 | | 5/1994 | Maher et al. . | |
| 5,314,003 | | 5/1994 | Mackay . | |
| 5,319,195 | | 6/1994 | Jones et al. . | |
| 5,322,436 | | 6/1994 | Horng et al. . | |
| 5,331,466 | | 7/1994 | Van Saarloos . | |
| 5,352,538 | | 10/1994 | Takeda et al. . | |
| 5,387,292 | | 2/1995 | Morishige et al. . | |
| 5,406,042 | | 4/1995 | Engelfriet et al. . | |
| 5,409,741 | | 4/1995 | Laude . | |
| 5,411,770 | | 5/1995 | Tsai et al. . | |
| 5,430,270 | | 7/1995 | Findlan et al. . | |
| 5,446,258 | | 8/1995 | Mordike . | |
| 5,449,536 | | 9/1995 | Funkhouser et al. . | |
| 5,466,906 | | 11/1995 | McCune, Jr. et al. . | |
| 5,484,980 | | 1/1996 | Pratt et al. . | |
| 5,486,677 | | 1/1996 | Maischner et al. . | |
| 5,491,317 | | 2/1996 | Pirl . | |
| 5,514,849 | | 5/1996 | Findlan et al. . | |
| 5,530,221 | | 6/1996 | Benda et al. . | |
| 5,546,214 | | 8/1996 | Black et al. . | |
| 5,563,095 | | 10/1996 | Frey . | |
| 5,614,114 | | 3/1997 | Owen . | |
| 5,643,641 | | 7/1997 | Turchan et al. . | |
| 5,659,479 | | 8/1997 | Duley et al. . | |
| 5,874,011 | | 2/1999 | Ehrlich . | |
| 5,985,056 | * | 11/1999 | McCay et al. | 148/512 |

OTHER PUBLICATIONS

Christodoulou, et al.; "Laser surface melting of some alloy steels," *Metals Technology*, Jun. 1983, vol. 10, 215–222.

Cullis, et al.; "A device for laser beam diffusion and homogenisation," J. Phys.E:Sci. Instrum., vol. 12, 1979, 668–689.

Dahotre, et al., "Development of microstructure in laser surface alloying of steel with chromium," *Journal of Materials Science*, vol. 25, 1990, 445–454.

Dahotre, et al., "Laser Surface Melting and Alloying of Steel with Chromium," *Laser Material Processing III*, 1989, 3–19.

Fernelius, et al.; "Design and Testing of a Refractive Laser Beam Homogenizer," *Airforce Writing Aeronautical Laboratories Report*, (AFWAL–TR–84–4042), Sep. 1984, 46 pages.

Frieden; "Lossless Conversion of a Plane Laser Wave to a Plane Wave of Uniform Irradiance," *Applied Optics*, vol. 4, No. 11, Nov. 1965, 1400–1403.

Galletti, et al.; "Transverse–mode selection in apertured super–Gaussian resonators: an experimental and numerical investigation for a pulsed $CO_2$ Doppler lidar transmitter," *Applied Optics*, vol. 36, No. 6, Feb. 20, 1997, 1269–1277.

Gori, et al.; "Shape–invariance range of a light beam," *Optics Letters*, vol. 21, No. 16, Aug. 15, 1996, 1205–1207.

Grojean, et al.; "Production of flat top beam profiles for high energy lasers," Rev. Sci. Instrum. 51(3), Mar. 1980, 375–376.

Hella, "Material Processing with High Power Lasers," *Optical Engineering*, vol. 17, No. 3, May–Jun. 1978, 198–201.

Ignatiev, et al.; "Real–time pyrometry in laser machining," *Measurement and Science Technology*, vol. 5, No. 5, 563–573.

"Laser Removing of Lead–Based Paint" Illinois Department of Transportation, Jun. 1992, 26 pages.

Jones, et al.; "Laser–beam analysis pinpoints critical parameters," *Laser Focus World*, Jan. 1993, 123–130.

Khanna, et al.; "The Effect of Stainless Steel Plasma Coating and Laser Treatment on the Oxidation Resistance of Mild Steel," *Corrosion Science*, vol. 33, No. 6, 1992, 949–958.

"New Products" *Laser Focus World*, Aug. 1996, 173.

Lugscheider, et al.;"A Comparison of the Properties of Coatings Produced by Laser Cladding and Conventional Methods," *Surface Modification Technologies V*, The Institute of Materials, 1992, 383–400.

Manna, et al.; "A One–dimensional Heat Transfer Model for Laser Surface Alloying of Chromium on Copper Substrate," *Department of Metallurgical & Materials Engineering*, Indian Institute of Technology, vol. 86, N. 5, May 1995, 362–364.

Mazille, et al.; "Surface Alloying of Mild Steel by Laser Melting of Nickel and Nickel/Chromium Precoatings," *Materials Performance Maintenance*, Aug. 1991, 71–83.

Molian; "Characterization of Fusion Zone Defects in Laser Surface Alloying Applications," *Scripta Metallurgica*, vol. 17, 1983, 1311–1314.

Molian; "Effect of Fusion Zone Shape on the Composition Uniformity of Laser Surface Alloyed Iron," *Scripta Metallurgica*, vol. 16, 1982, 65–68.

Molian; Structure and hardness of laser–processed Fe–0.2%C–5%Cr and Fe–0.2%C–10%Cr alloys; *Journal of Materials Science*, vol. 20, 1985, 2903–2912.

"Line–Focussing Optics for Multiple–Pass Laser Welding," NASA Tech Briefs MFS–29976, date unknown.

"Cylindrical Lenses," *Newport Technical Guide*, date unknown, N–65.

"Fused Silica Cylindrical Lenses," *Newport Technical Guide*,, date unknown, N–68.
Oswald, et al.; "Measurement and modeling of primary beam shape in an ion microprobe mass analyser," IOP Publishing Ltd., 1990, 255–259.
Renaud, et al., "Surface Alloying of Mild Steel by Laser Melting of an Electroless Nickel Deposit Containing Chromium Carbides," *Materials & Manufacturing Processes*, 6(2), 1991, 315–330.
Smurov, et al.; "Peculiarities of pulse laser alloying: Influence of spatial distribution of the beam," J. Appl. Phys. 71(7), Apr. 1, 1992, 3147–3158.
"Spawr Integrator," Spawr Optical Research, Inc., Data Sheet No. 512, Jun. 1986.
Veldkamp, et al.; "Beam profile shaping for laser radars that use detector arrays," *Applied Optics*, vol. 21, No. 2, Jan. 15, 1982, 345–358.
Veldkamp; "Laser Beam Profile Shaping with Binary Diffraction Gratings," *Optics communications*, vol. 38, No. 5,6, Sep. 1, 1981, 381–386.
Veldkamp; "Laser beam profile shpaing with interlaced binary diffraction gratings," *Applied Optics*, vol. 21, No. 17, Sep. 1, 1982, 3209–3212.
Veldkamp; "Technique for generating focal–plane flattop laser–beam profiles," Rev. Sci. Instru., vol. 53, No. 3, Mar. 1982, 294–297.
Walker, et al.; "Laser surface alloying of iron and 1C–1·4Cr steel with carbon," *Metals Technology*, vol. 11, Sep. 1984, 5 pages.
Walker, et al.; "The laser surface–alloying of iron with carbon," Journal of Material Science vol. 20, 1985, 989–995.

Wei, et al.; "Investigation of High–Intensity Beam Characteristics on Welding Cavity Shape and Temperature Distribution," Journal of Heat Transfer, vol. 112, Feb. 1990, 163–169.

Charschan, "Lasers in industry," *Laser Processing Fundamentals*, (Van Nostrand Reinhold Company), Chapter 3, Sec. 3–1, 139–145.

Fernelius, et al; "Calculations Used in the Design of a Refractive Laser Beam Homogenizer," *Airforce Writing Aeronautical Laboratories Report*, (AFWAL–TR–84–4047), Aug. 1984, 18 pages.

Jain, et al.; "Laser Induced Surface Alloy Formation and Diffusion of Antimony in Aluminum," *Nuclear Instruments and Method*, vol. 168, 275–282, 1980.

Molian; "Estimation of cooling rates in laser surface alloying processes," Journal of Materials Science Letters, vol. 4, 1985, 265–267.

"High Power CW Nd:YAG Laser Transformation Hardening," Hobart Laser Products, 2 pages.

* cited by examiner

METHOD FOR PRODUCING ALLOYED BANDS OR STRIPS ON PISTONS FOR INTERNAL COMBUSTION ENGINES

BACKGROUND OF THE INVENTION

1. Field of the Invention

This invention relates to a method of using a laser to produce alloyed bands or strips on the surface of a piston for an internal combustion engine. More specifically, the present invention relates to a laser alloying method to produce superior wear resistant properties for an aluminum internal combustion engine piston.

2. Description of the Prior Art

Internal combustion engines comprise reciprocating pistons which are exposed to harsh environmental conditions, including high temperatures, and friction. Prior art pistons have been plated with chrome in order to enhance their wear resistant characteristics. Chrome plating is expensive and is subject to deterioration from harsh environmental conditions present in internal combustion engines.

SUMMARY OF THE INVENTION

The present invention is directed toward a process or method for producing alloyed bands or strips on an aluminum piston for use in an internal combustion engine. The present invention comprises applying a precursor layer comprising a binder and metallic or ceramic powder to the surface of an aluminum piston, as shown in Block 10 of FIG. 1. The precursor layer has a thickness in the range of 50–100 microns.

The invention further comprises irradiating the piston surface with a laser beam at a sufficient energy level and for a sufficient time to produce an alloyed layer on the surface of the piston having enhanced wear characteristics, as shown in Block 12 of FIG. 1. During irradiation, the piston and the laser beam are moved relative to each other.

DESCRIPTION OF THE PREFERRED EMBODIMENTS

Figure 1:
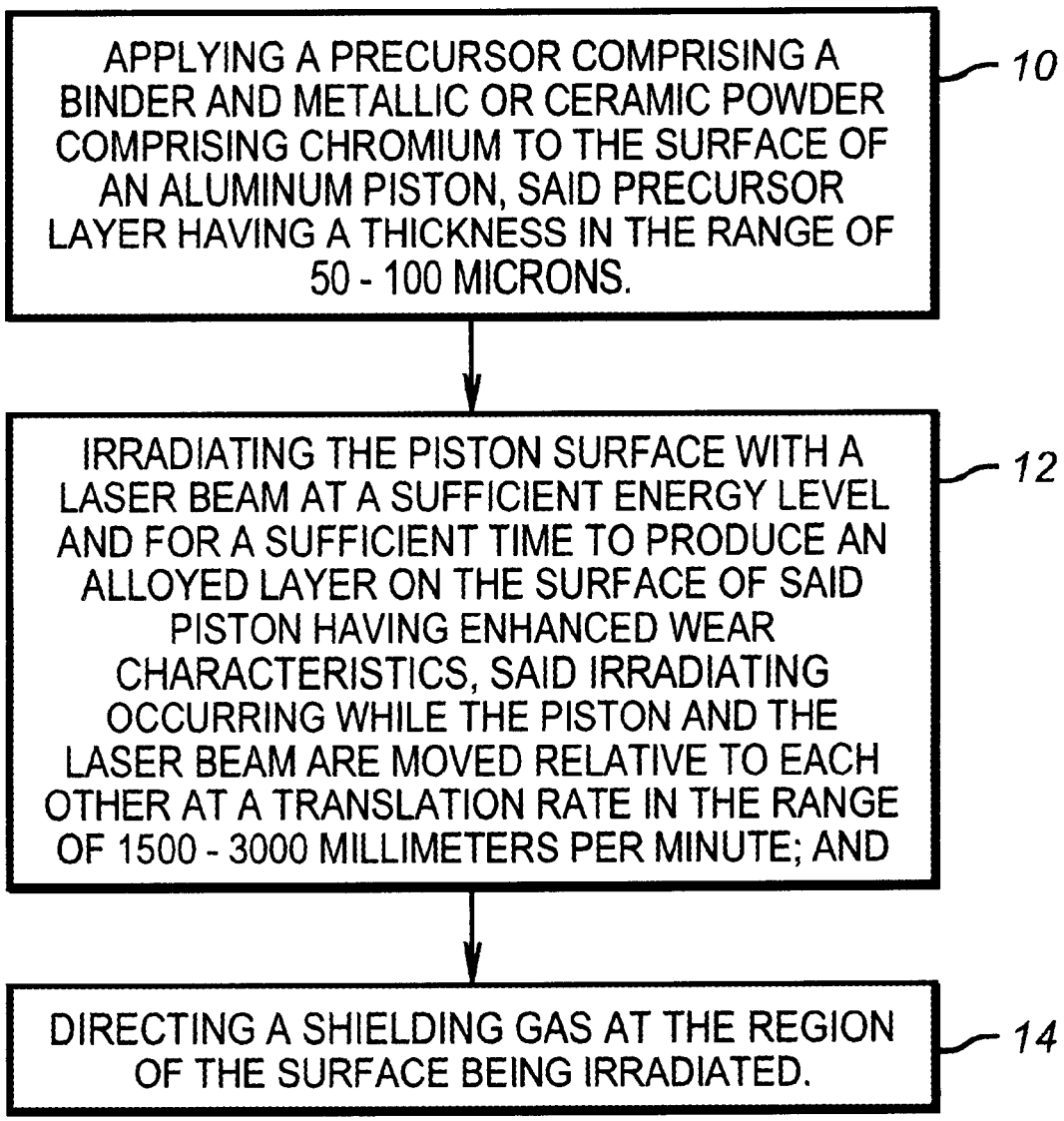
FIG. 1 is a block diagram depicting the method of the present: invention.

The present invention comprises applying a precursor layer 21 comprising a binder and metallic or ceramic powder to the surface of an aluminum piston 20, as shown in Block 10 of FIG. 1. The precursor layer has a thickness in the range of 50–100 microns.

The invention further comprises irradiating the piston surface with a laser beam 22 at a sufficient energy level and for a sufficient time to produce an alloyed layer on the surface of the piston having enhanced wear characteristics, as shown in Block 12 of FIG. 1.

Figure 2:
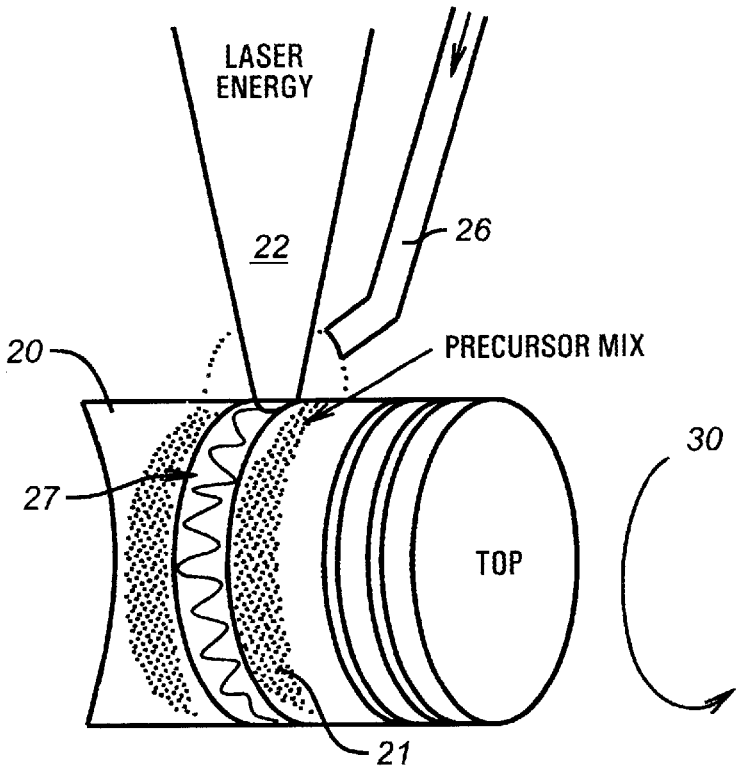
FIG. 2 is an isometric view of an apparatus suitable for practicing the present invention.
Figure 3:
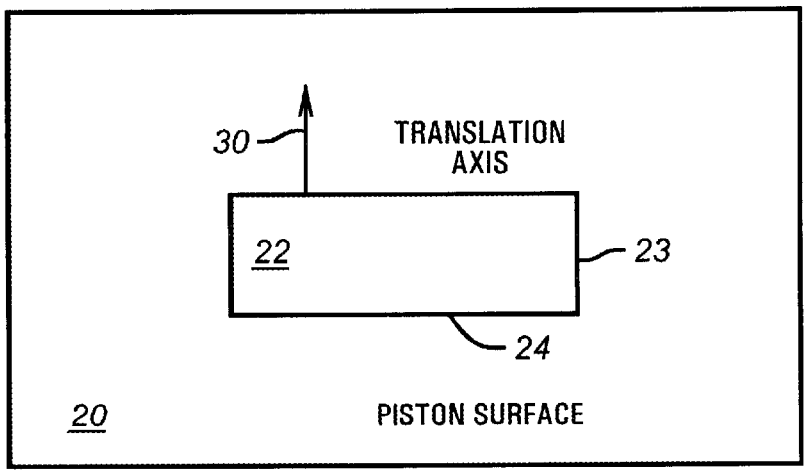
FIG. 3 is an enlarged front view of the laser beam cross sectional area on the surface of the piston when practicing the method of the present invention.

During the irradiation of the piston, the piston and the laser beam are moved relative to each other along a translation axis 30, as shown in FIGS. 2 and 3. In a preferred embodiment, the piston is moved with respect to the laser beam at a preselected rate and in a preselected pattern so as to produce alloyed strips 27 on the piston, as shown in FIG. 2. In another preferred embodiment, the piston is moved relative to the laser beam at a translation rate in the range of 1500–3000 millimeters per minute, as shown in Block 12 of FIG. 1. In another preferred embodiment, at least one of the alloyed strips extends circumferentially around the piston, as shown in FIG. 2.

In a preferred embodiment, the present invention further comprises directing a shielding gas 26 at the region of the surface being irradiated by the beam, as shown in FIG. 2 and in Block 14 of FIG. 1. In a preferred embodiment, the shielding gas is nitrogen or argon.

In a preferred embodiment, the laser beam has a rectangular cross sectional area 22, as shown in FIG. 3. This rectangular cross sectional area comprises two shorter sides 23 and two longer sides 24 as shown in FIG. 3. In another preferred embodiment, the longer sides of the rectangular cross sectional area have a length of at least four millimeters and the shorter sides of the rectangular cross sectional area have a length of at least 0.6 millimeters. A rectangular beam profile having the dimensions described above can be achieved by aligning a spherical lens closest to the beam, a second cylindrical lens closest to the substrate and a first cylindrical lens between the spherical lens and the second cylindrical lens. The spherical lens should have a focal length of 101.6 millimeters and the first cylindrical lens should have a focal length of 203.2 millimeters. The second cylindrical lens should have a focal length of 152.4 millimeters. The spherical lens and the first cylindrical lens should be spaced apart by five millimeters. The first cylindrical lens and second cylindrical lens should be spaced apart 15 millimeters.

In a preferred embodiment, the longer sides of the rectangular cross sectional area of the laser beam are perpendicular to the translation axis 30 of the beam relative to the piston, as shown in FIG. 3. In another preferred embodiment, the laser beam used for irradiating has a power in the range of 115–135 kilowatts/cm$^2$. In another preferred embodiment the laser beam has a power density of 125 kilowatts/cm$^2$.

The foregoing disclosure and description of the invention are illustrative and explanatory. Various changes in the size, shape, and materials, as well as in the details of the illustrative construction may be made without departing from the spirit of the invention.

What is claimed is:

1. A method for producing alloyed strips on an aluminum internal combustion engine piston comprising:

a. applying a precursor comprising a binder and metallic or ceramic powder comprising chromium to the surface of an aluminum piston, said precursor layer having a thickness in the range of 50–100 microns; and b. irradiating the piston surface with a laser beam having a rectangular cross sectional area at a sufficient energy level and for a sufficient time to produce an alloyed layer on the surface of said piston having enhanced wear characteristics, said irradiating occurring while the piston and the laser beam are moved relative to each other.

2. The method of claim 1, further comprising moving said piston with respect to said laser beam so as to produce alloyed strips on said piston.

3. The method of claim 2, wherein said piston is moved rotationally with respect to said laser beam so that at least one of said alloyed strips extends circumferentially around said piston.

4. The method of claim 2, wherein said piston is moved relative to said beam at a translation rate in the range of 1500–3000 millimeters per minute.

5. The method of claim 1, further comprising directing a shielding gas ,at the region of the surface being irradiated by said beam.

6. The method of claim 5, wherein said gas is nitrogen or argon.

7. The method of claim 1, wherein said irradiating is performed with a laser beam having a power in the range of 115–135 kilowatts/$cm^2$.

8. A method for producing alloyed strips on an aluminum internal combustion engine piston comprising:

a. applying a precursor comprising a binder and metallic or ceramic powder comprising chromium to the surface of an aluminum piston, said precursor layer having a thickness in the range of 50–100 microns;

b. irradiating the piston surface with a laser beam having a rectanglar cross sectional area at a sufficient energy level and for a sufficient time to produce an alloyed layer on the surface of said piston having enhanced wear characteristics, said irradiating occurring while the piston and the laser beam are moved relative to each other at a translation rate in the range of 1500–3000 millimeters per minute; and c. directing a shielding gas at the region of the surface being irradiated.

9. The method of claim 8, wherein said irradiating is performed with a laser beam having a power in the range of 115–135 kilowatts/$cm^2$.

10. The method of claim 8, wherein said gas is nitrogen or argon.

11. The method of claim 8 wherein the longer sides of said rectangular cross sectional area are perpendicular to the translation axis of said beam relative to said piston.

12. The method of claim 11 wherein said longer sides are at least 4 millimeters long and said shorter sides are at least 0.6 millimeters long.

13. A method for producing alloyed strips on an aluminum internal combustion engine piston comprising:

a. applying a precursor comprising a binder and metallic or ceramic powder comprising chromium to the surface of an aluminum piston, said precursor layer having a thickness in the range of 50–100 microns;

b. irradiating the piston surface with a laser beam having a rectangular cross sectional area at a sufficient energy level and for a sufficient time to produce an alloyed layer on the surface of said piston having enhanced wear characteristics, said irradiating occurring while the piston and the laser beam are moved relative to each other; and c. directing argon or nitrogen gas at the region of the surface being irradiated.

14. The method of claim 13 comprising moving said piston with respect to said laser beam so as to produce alloyed strips on said pistons.

15. The method of claim 14 wherein said piston is moved relative to said beam at a translation rate in the range of 1500–3000 millimeters per minute.

* * * * *